United States Patent [19]

Reed et al.

[11] 4,052,142

[45] Oct. 4, 1977

[54] AIR VELOCITY BURNER

[75] Inventors: Robert D. Reed; Robert E. Schwartz, both of Tulsa, Okla.

[73] Assignee: John Zink Company, Tulsa, Okla.

[21] Appl. No.: 686,750

[22] Filed: May 17, 1976

[51] Int. Cl.[2] ..... F23D 15/00

[52] U.S. Cl. ..... 431/202; 23/277 C

[58] Field of Search ..... 431/5, 202, 283, 284; 23/277 C

[56] References Cited

U.S. PATENT DOCUMENTS

| | | | |
|---|---|---|---|
| 3,547,567 | 12/1970 | Turpin | 431/202 |
| 3,697,231 | 10/1972 | Reed | 23/277 C |
| 3,954,385 | 5/1976 | Reed et al. | 431/202 |

*Primary Examiner*—Edward G. Favors

*Attorney, Agent, or Firm*—Head, Johnson & Chafin

[57] ABSTRACT

An improved burner head for a flare stack for the smokeless combustion of waste combustible gases which comprises an outer and an inner cylindrical conduit, a burner comprising a multiplicity of radial arms attached to the inner cylinder, which is closed off at the top. Means are provided for producing an upward flow of primary combustion air at substantial velocity to flow up the annular space between the inner and outer cylinders and between the radial arms of the burner. Means are provided for conducting the combustible gases upwardly through the inner cylinder and through ports arranged along the radial arms to provide jets of gas directed upwardly and laterally from the arms, so that the jets of gas will turbulently mix with the primary combustion air. A plurality of triangular baffles are positioned symmetrically between each pair of radial arms. The baffles are attached as by welding to the inner top edge of the outer cylinder, leaving a plurality of narrow spaces between the edges of the baffles and the arms for the flow of primary air. The upward flow of primary air is at high velocity, causing an induction of secondary air along the edges of the narrow spaces between the arms, the baffles, and the outer cylinder.

10 Claims, 11 Drawing Figures

AIR VELOCITY BURNER

BACKGROUND OF THE INVENTION

This invention lies in the field of the flare burning of combustible waste gases.

More particularly, this invention lies in the field of means for smokeless combustion of flared gases without the use of steam.

Further, this invention lies in the field of the smokeless burning of combustible gases in a flare stack where the energy for the turbulent mixing of primary and secondary air and combustible gas is derived from a stream of primary air and the energy of the flow of waste gases.

In the prior art, it has been customary, in order to obtain smokeless complete combustion of waste gases that are flared into the atmosphere, to provide means, such as the use of steam jets, which by their mechanical and chemical action promote the smokeless combustion of the waste gases. The use of steam not only provides additional capital investment in the flare stack, but requires a continual expenditure of energy to provide the steam.

It is therefore a primary object of this invention to provide a burner system for a flare stack which utilizes the energy imparted by fan or blower to the primary air to better advantage for the combustion of the gases, to promote turbulent mixing between the primary air and the fuel gas, and the induction of sufficient secondary air to completely and turbulently, smokelessly, burn the waste gases.

SUMMARY OF THE INVENTION

These and other objects are realized and the limitations of the prior art are overcome in this invention by providing a vertical outer cylindrical stack for the flare, through which primary air flows as a result of the blower, fan or similar conventional means for imparting velocity to the primary air, and an internal cylindrical conduit for carrying the waste gases that are to be burned. A burner is mounted at the top of the inner cylinder, which burner comprises a plurality of radial arms, equally spaced, between the inner cylinder and the inner surface of the outer cylinder at the top of the outer cylinder.

Each of the radial arms is of box construction, entirely enclosed on top, sides, and bottom, and having two rows of ports along the length of the arms, equally spaced, and directed laterally outwardly and upwardly from the arms.

A plurality of triangular-shaped baffles are mounted to the inner surface of the outer cylinder near its top. Each of the baffles is symmetrically placed within the space between a pair of radial arms. The angle of the baffle is substantially equal to the angle between adjacent arms. This leaves a narrow, V-shaped space within each pair of arms for the flow of primary combustion air. Since the cross-sectional area of the V-shaped passages between the baffles and the arms is a fraction of the cross-section of the annular space between the inner and outer cylinders, there will be a substantial increase in flow velocity of the primary air through the V-shaped spaces, causing an induction of secondary air along the edges of the baffles between the spider arms and the edge of the outer cylinder.

The ports in the arms of the burner, or spider arms produce a plurality of jets of gas which are directed laterally to the length of the arms of the spider. These jets impinge on the sheets of air flowing up through the V-shaped openings and cause turbulent mixing between the gas and primary air and also between the mixture of gas and primary air with induced secondary combustion air. The turbulence of the mixture of air and gas is such as to completely mix the gas with at least stoichiometric air for the complete combustion of the gas.

Because of the high velocity of the primary air and the effect of the baffles, which provide narrow passages for the primary air, and the long surface for contact between the high velocity air and the atmosphere over the baffles, there is increased ability to induce secondary air which flows inward over the top edge of the outer cylinder and across the baffle surfaces to be mixed with the rapidly rising primary air.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
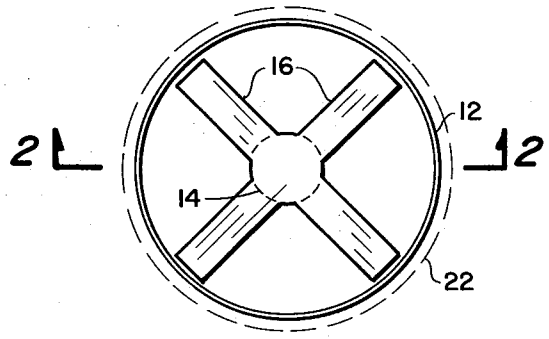
Fig. 1 PRIOR ART
FIGS. 1 and 2 represent respectively plan and vertical cross-section of a prior art type of flare burner.

Referring now to the drawings, and in particular, to FIG. 1, there is shown a prior art type of flare burner in which there are two cylinders—an inner cylinder 14 which carries the gas to be burned in the flare, and an outer cylinder 12 which is arranged symmetrically about the inner cylinder. There are means, not shown, but well known in the art, to supply primary air at substantial velocity in the annular space between the inner cylinder 14 and outer cylinder 12 for combustion of the gas. Arrows 18 indicate the flow of primary air, and arrow 20 represents the flow of gas to be burned.

Figure 2:
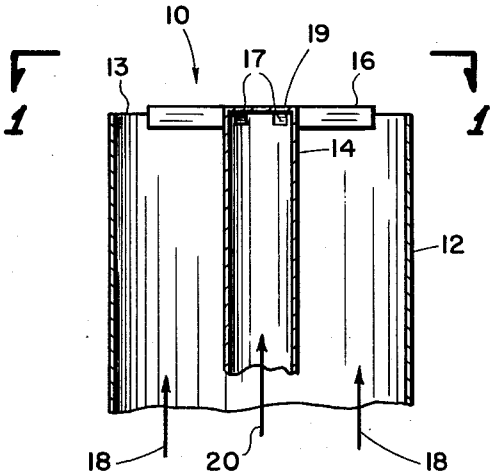
Fig. 2 PRIOR ART

In FIGS. 1 and 2, there is shown an embodiment of burner 10 with four radial arms 16 attached at the top of the inner cylinder 14 and inserted in the wall of the cylinder 14 with the top of the cylinder 14 closed as by plate 19. In operation, the gas 20 flows up the inner cylinder, through the openings 17 into the arms 16, and through the ports, not shown, upwardly to mix with the air 18 which passes up between the radial arms 16.

While the cross-section of the cylinders 12 and 14 may be any shape desired, it is convenient and economical to utilize circular cylinders 12 and 14; and for convenience, though without limitation, the invention will be described in terms of circular, concentric cylinders.

Shown in FIG. 1 is a dashed circle outside of the outer cylinder at its top edge. This is to indicate that on one side of the cylinder 12 is outside atmospheric air, and inside the cylinder 12 is an upwardly moving stream of combustion supporting primary air. At the top edge 13 of the outer cylinder, there will be reduced pressure on the inside surface of the cylinder 12. This less than atmospheric pressure causes an inflow of atmospheric air over the top edge 13 of the cylinder 12 which is induced by the upward flow of primary air. The two volumes of air are turbulently mixed in the vicinity of the top edge 13. The dashed line 20 is drawn to indicate that this zone of induction is formed at the top edge 13 of the cylinder 12.

Figure 3:
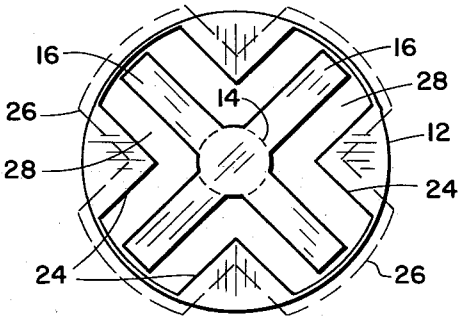
FIGS. 3 and 4 represent plan view and vertical cross-section of one embodiment of this invention.
Figure 4:
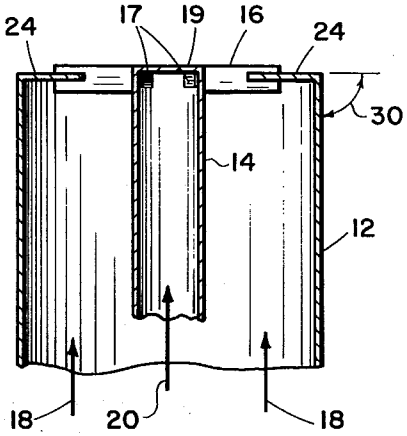

In FIGS. 3 and 4 is shown an improved type of burner which forms one embodiment of this invention which, like that of FIGS. 1 and 2, includes an inner an outer cylinder 14 and 12, with a burner utilizing a plurality of radial arms 16 inserted into the top wall of the cylinder 14, the top of which is closed by plate 19. However, in FIGS. 3 and 4, there are a plurality of baffles 24 of triangular shape, each inserted between one pair of arms. The angle of the isosceles triangle forming the baffle is parallel to the sides of the arms 16, leaving a plurality of V-shaped spaces of substantially uniform width between the baffle edges and the arms.

The cross-sectional area of the V-shaped spaces 28 is considerably smaller than the cross-sectional area of the annular space between the cylinders 14 and 12, so that the velocity of air passing through the spaces 28 is much higher than the velocity of the air in the annular space represented by arrows 18. This higher velocity of air provides a greater opportunity for induction of atmospheric air over the top of the baffles 24. This greater ability to induce air into the spaces 28 is measured by the relative length of the perimeter of the dashed line 26, as compared to the dashed line 22, and by the higher velocity of air in the embodiment of FIGS. 3 and 4.

It is therefore seen that the embodiment of FIGS. 3 and 4 is much more effective in inducing atmospheric air into the primary air and gas mixture, and therefore to turbulently provide the full stoichiometric air that is required.

The volume of primary air that passes upwardly through the V-shaped openings 28 will vary depending upon the width of these V-shaped members. As the baffle area is increased and the arms of the V-shaped spaces is decreased, the greater restriction causes a higher velocity, and an increase in perimeter 26, so that a greater volume of secondary air can be induced. It is possible, therefore, to use primary air which may be a relatively small fraction of the stoichiometric quantity (as low as 10%) and still provide the total required stoichiometric volume of combustion air by induction.

In FIGS. 3 and 4, the baffles 24 and the arms 16 are shown to be in substantially a plane, which is perpendicular to the axis of the cylinders 12 and 14.

Figure 5:
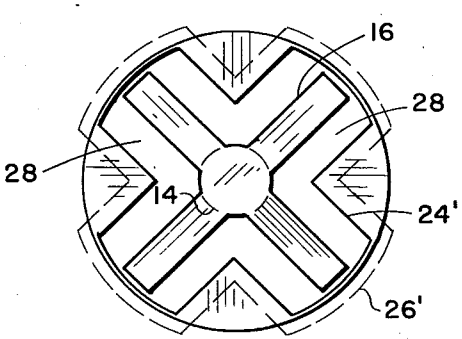
FIGS. 5 and 6 represent respectively plan and vertical elevation views of another embodiment of this invention.
Figure 6:
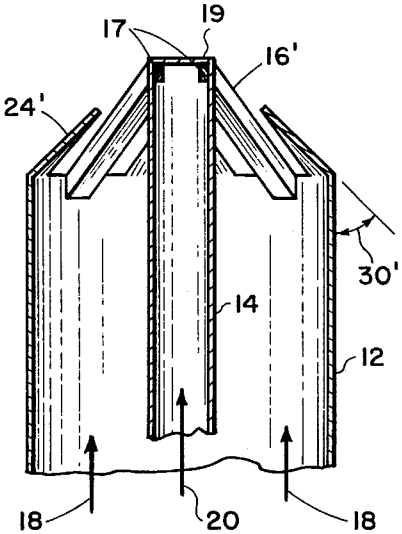

In FIGS. 5 and 6, a similar situation is shown to that in FIGS. 3 and 4, except that the arms and baffles are no longer in a transverse plane but are in a surface, which is a conical surface, whose axis lies in the axis of the cylinders 12 and 14. By making the surfaces of the baffles 24' and the arm 16' in the shape of a cone, the edges of the baffles 24' represented by the perimeter dashed line 26' will be longer than the edges of the baffles 24 because of the conical geometry. Consequently, the conical arrangement of FIGS. 5 and 6 is more effective in inducing secondary air into the combustion zone than is the system of FIGS. 3 and 4. Thus, the system of FIGS. 5 and 6 is to be preferred.

In FIGS. 3 and 4, the angle 30 between the surface of the baffles 24 and the axis of the cylinders is shown to be 90°, while in FIGS. 5 and 6, the angle represented by 30' is shown to be approximately 45°, which means that the surface of the baffles 24' will be approximately 45° to the vertical.

Because of the conical nature of the surface of the baffles and of the arms, the perimeter 26' will be approximately 38% greater than the perimeter 22 of FIGS. 1 and 2, while the perimeter 26 of FIGS. 3 and 4 will be substantially 22% greater than the perimeter 22. Consequently, the ability to induce inflow of secondary air is likewise in the ratios of the length of the perimeters 26' and 26 with respect to 22.

Figure 7:
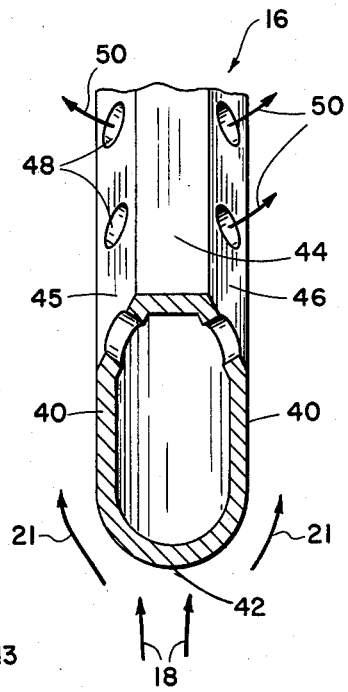
FIG. 7 represents in partial cross-section the embodiment of one type of radial arm of the burner.
Figure 9:
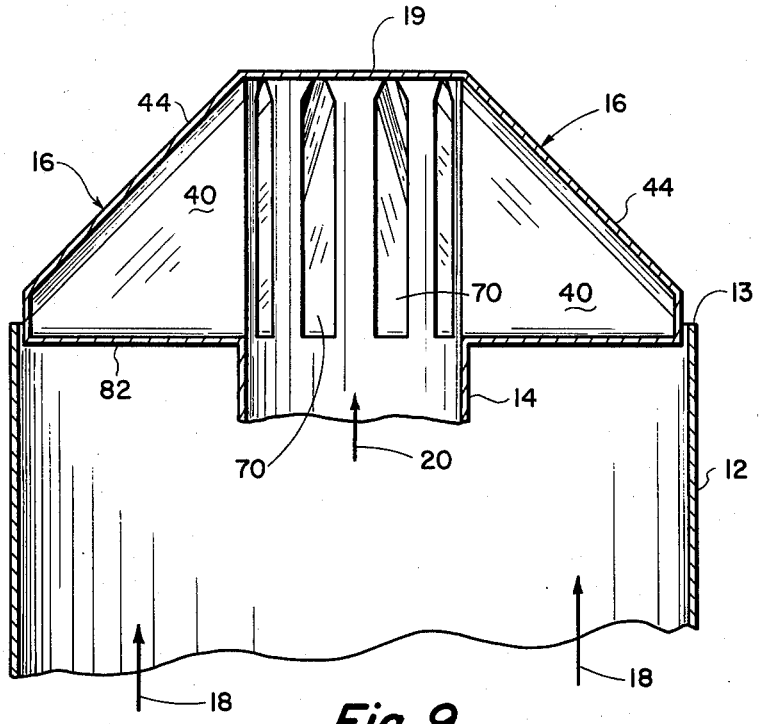

FIG. 7 represents in partial cross-section one embodiment of the arms 16 which are joined to the central cylinder 14. These are substantially rectangular in cross-section having two sidewalls 40, 40, a bottom 42, which can be square as shown in FIG. 9, or rounded as shown in FIG. 7. The top is preferably made of a bent section with a flat top 44 and two angular walls 45 and 46 joined to the sidewalls 40. A plurality of ports 48 are shown spaced longitudinally along the arms and punched into the surfaces 45 and 46. Thus, when the surface 44 is horizontal, for example, as it would be in the case of FIG. 3, the jets 50 of gas flowing out through the ports 48 would be upward and lateral of the arms, and therefore, the jets would be injected into the rapidly rising sheets of primary air passing through the V-shaped spaces 28 between the baffles and the arms. The flow of combustion gas is indicated in a general way by the arrows 50 in FIG. 7. Also in FIG. 7, the uprising flow of primary air 18 is shown to be diverted along the sides of the arms in accordance with arrows 21 into the spaces 28.

Figure 8:
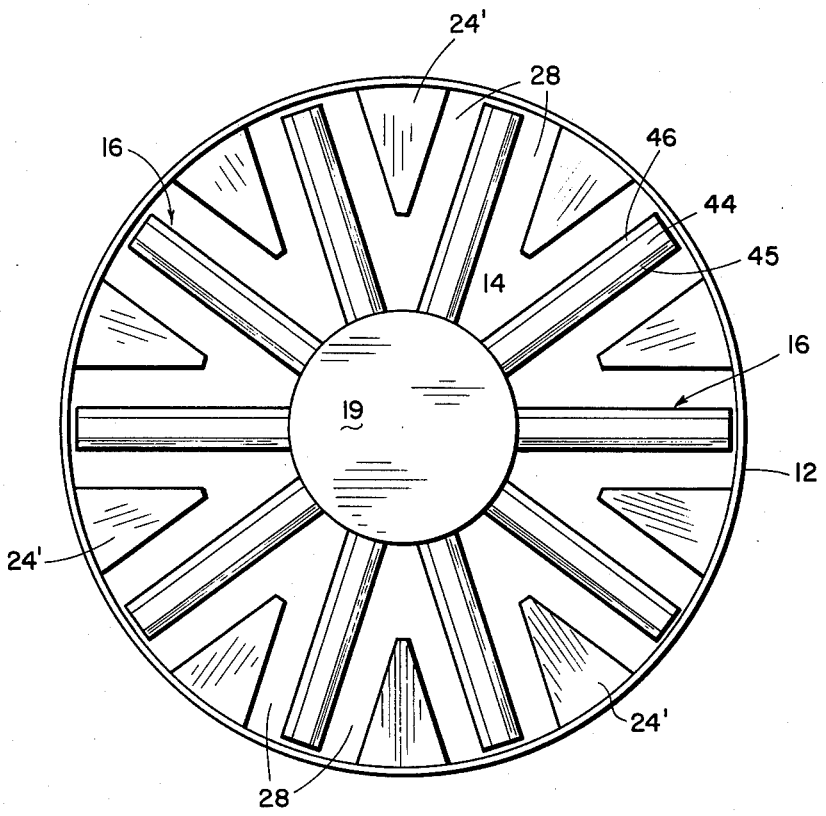
FIGS. 8 and 9 represent respectively plan and vertical sections of another embodiment of this invention.

The type of arms shown in FIGS. 3, and 4, and 5, and 6 have the cross-section of the arms substantially constant. This construction shown in FIG. 7 is ideal. However, where the angle 30' of the conical surface passing through the baffle and arms is as shown in FIGS. 8 and 9, it is convenient to make the arms with triangular shaped sidewalls 40 so that the openings 70 where the arms are inserted into the walls of the cylinder 14 will permit the flow of gas over a larger area, into each of the arms, and out through the ports in the top surface of the arms 16. FIG. 8 illustrates the type of top portion of the arm which comprises surfaces 44 and 45 and 46, but for simplicity does not illustrate the ports, which, however, are shown in FIGS. 10 and 11.

Figure 10:
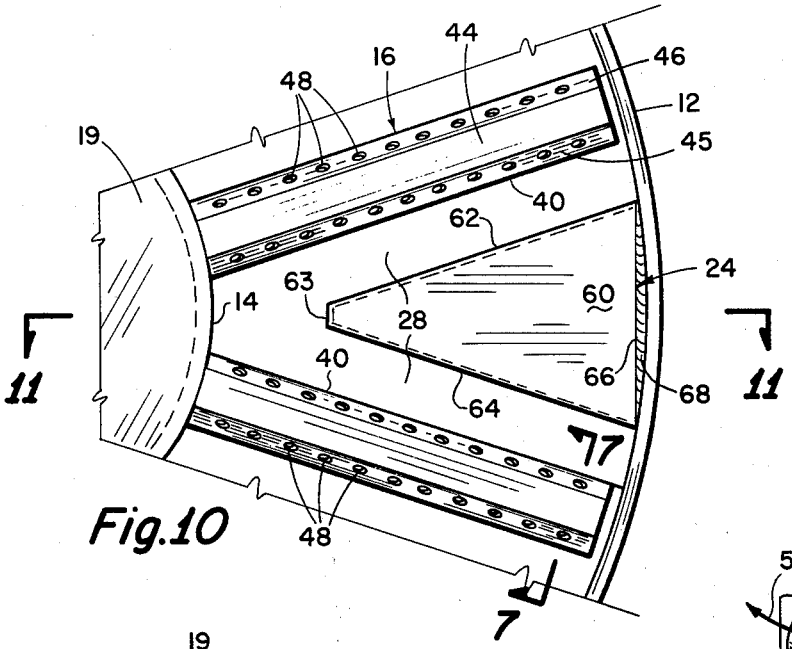
FIGS. 10 and 11 represent respectively partial plan view and vertical section view of another embodiment of this invention.
Figure 11:
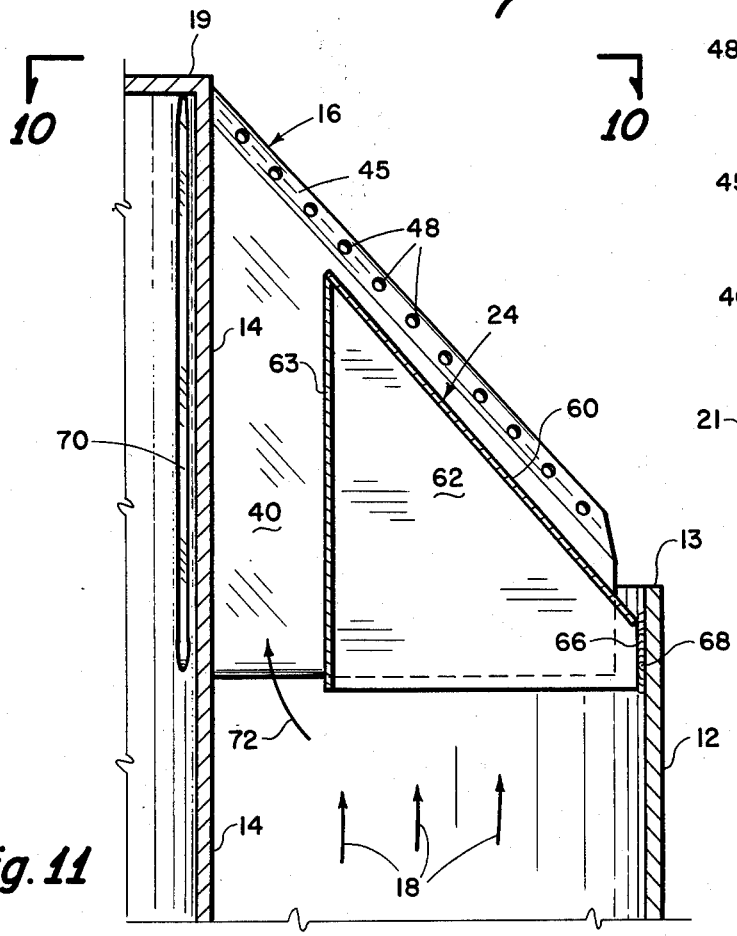

AS shown in FIG. 8, with the triangular shaped arms 16, the baffles 24' can be made of just a simple triangular plate which is held to the inside top edge of the cylinder 12; however, as shown in FIGS. 10 and 11, another possible arrangement is provided by making the baffles 24 in the shape of triangular cross-section truncated prisms, having walls 62, 63, 64, and 66, with the wall 66 attached, as by welds 68, to the inner surface of the outer cylinder 12. Thus, the V-shaped spaces 28 between the arms and the baffles in FIGS. 10 and 11 comprise a long narrow space between the sidewalls 62 and 64 of the baffles and the sidewalls 40 of the arms.

The lower portion of the flare stack in which the flow of primary air is generated, such as by means of blowers or fans, or the like, is so well known in the art, that it is not repeated here. This part of the apparatus forms no part of the invention. The invention lies in the use of a multiple arm burner with triangular-shaped baffles interspered between the arms, so as to provide narrow V-shaped passages for the flow of primary air between the baffles and the burners, so as to generate a turbulent mixing of primary air and waste gas, and the induction of the necessary stoichiometric quantity of secondary air to turbulently mix with the primary air and gas.

As mentioned previously, the surface represented by the baffles and the arms can be a plane surface transverse to the direction of flow of the gas and primary air, or it can be a substantially conical surface, the latter being preferred. A preferred angle of the conical surface would be one in which the angle at the peak of the cone would be 90° or the surface would be at substantially 45° with respect to the vertical elements of the inner and outer cylinders.

Any desired quantity of primary air expressed as a fraction of the stoichiometric quantity can be used from an amount as small as 10% up to the full stoichiometric value. However, a preferred quantity lies in the range of 10 to 50% of the stoichiometric value with the remainder of the combustion air being derived by induction at the surface of the baffles as the primary air passes upwardly through the V-shaped openings.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. In a flare stack for the atmospheric combustion without smoke of waste combustible gases, said stack comprising an outer vertical cylindrical conduit, an inner smaller vertical conduit for the upward flow of combustible gases, and a burner connected to the top of the inner conduit, near the top of the outer conduit, the flow of primary combustion air being through the annular space between said outer and inner conduits;

the improvement comprising an air velocity burner comprising;

a. said burner comprising a plurality of radial arms, attached to said inner vertical conduit;

b. each of said radial arms including ports along its length, said ports directed upwardly of said arms;

c. a plurality of baffles equal in number to said plurality of radial arms; each baffle of the shape of a triangle with its base attached to the top edge of said outer cylindrical conduit; the peak angle of said triangle being substantially equal to the angle between adjacent radial arms of said burner, said baffles positioned symmetrically in the spaces between said arms;

d. each of said baffles including at least a triangular metal sheet substantially in the plane of said radial arms;

whereby the upward flow of primary combustion air is restricted to flow through the narros V-shaped spaced between the edges of said baffles and the sides of said arms;

whereby, because of the restriction in flow area, the flow of velocity of said primary combustion air is increased and there is turbulent mixing of said primary air and said fuel flowing from said ports; and whereby the flow velocity of said primary air over the edges of said baffles causes secondary air to be inducted and turbulently mixed with said fuel and primary air.

2. The burner as in claim 1 in which said number of radial arms is in the range of 3 to 14.

3. The burner as in claim 1 in which said number of radial arms is in the range of 6 to 10.

4. The burner as in claim 1 in which the flow rate of said primary combustion air is in the range of 10 to 50% of the stoichiometric value.

5. A burner of claim 1 wherein each of said radial arms includes two rows of ports, said ports directed upwardly and outwardly of said arms.

6. In a flare stack for the atmospheric combustion without smoke or waste combustible gases, said stack comprising an outer vertical cylindrical conduit, an inner smaller vertical conduit for the upward flow of combustible gases, and a burner connected to the top of the inner conduit, near the top of the outer conduit, the flow of primary combustion air being through the annular space between said outer and inner conduits;

the improvement comprising an air velocity burner, comprising;

a. said burner comprising a plurality of radial arms, attached to said inner vertical conduit;

b. each of said radial arms including ports along its length, said ports directed upwardly of said arms;

c. a plurality of baffles equal in number to said plurality of radial arms; each baffle of the shape of a triangle with its base attached to the top edge of said outer cylindrical conduit; the peak angle of said triangle being substantially equal to the angle between adjacent radial arms of said burner, said baffles positioned symmetrically in the spaces between said arms;

d. and wherein the surface passing through said baffles and said arms is substantially a conical surface symmetrical about the axis of said inner and outer conduits;

whereby the upward flow of primary combustion air is restricted to flow through the narrow V-shaped spaces between the edges of said baffles and the sides of said arms;

whereby, because of the restriction in flow area, the flow velocity of said primary combustion air is increased and there is turbulent mixing of said primary air and said fuel flowing from said ports; and whereby the flow velocity of said primary air over the edges of said baffles causes secondary air to be inducted and turbulently mixed with said fuel and primary air.

7. The burner as in claim 6 in which the angle of said cone is in the range of 160° to 60°.

8. The burner as in claim 6 in which each of said arms includes side walls which are triangular in shape, the bottom edge closed, and the vertical edge inserted into the wall of said inner conduit at its top, the top of said inner conduit closed.

9. The burner as in claim 8 in which each of said baffles comprises a confined space of triangular cross-section of the same triangular shape as those of said arms.

10. A burner as in claim 7 in which the upward slant of said conical-shaped baffle causes the downward slant of said spider arms to be parallel with said conical-shaped baffle.

* * * * *